US012606940B2

(12) United States Patent
Mizuhashi et al.

(10) Patent No.: US 12,606,940 B2
(45) Date of Patent: Apr. 21, 2026

(54) FIBER PROCESSING METHOD

(71) Applicant: SEIKO EPSON CORPORATION, Tokyo (JP)

(72) Inventors: Hideaki Mizuhashi, Chino (JP); Hideki Kojima, Matsumoto (JP); Hideki Tanaka, Chino (JP); Masahiko Nakazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 19/060,837

(22) Filed: Feb. 24, 2025

(65) Prior Publication Data

US 2025/0270742 A1 Aug. 28, 2025

(30) Foreign Application Priority Data

Feb. 26, 2024 (JP) ..... 2024-026257

(51) Int. Cl.
*D01G 11/04* (2006.01)

(52) U.S. Cl.
CPC ..... *D01G 11/04* (2013.01)

(58) Field of Classification Search
CPC ..... D01G 11/02; D01G 11/04; D01G 15/06; D04H 1/4274; D21B 1/06; D21B 1/061; D21B 1/063; D21B 1/08; Y02W 30/66; B02C 23/10
See application file for complete search history.

(56) References Cited

U.S. PATENT DOCUMENTS 3,508,713 A * 4/1970 Huppke ..... D21B 1/063 241/27
2011/0250425 A1* 10/2011 Lightman ..... D04H 1/425 428/221
2013/0227820 A1* 9/2013 Lutzkendorf ..... D01G 11/02 241/185.6
2016/0002829 A1* 1/2016 Lightman ..... D04H 1/04 19/65 R

FOREIGN PATENT DOCUMENTS

EP 3739112 A1 * 11/2020 ..... D21F 9/04
JP H06316848 A * 11/1994 ..... H04H 1/74
JP 2017-531103 A 10/2017
WO 2016/057353 A1 4/2016
WO WO-2023131919 A1 * 7/2023 ..... F26B 5/08

* cited by examiner

*Primary Examiner* — Aiying Zhao
(74) *Attorney, Agent, or Firm* — Spencer Fane LLP

(57) ABSTRACT

A fiber processing method includes performing defibration processing on a coarse fragment of a fabric containing a thread in which a plurality of fibers are twisted to produce a first defibrated material; and performing garnetting processing on the first defibrated material to produce a second defibrated material. The fiber processing method may further include, before performing the defibration processing, coarsely fragmenting the fabric to produce the coarse fragment.

5 Claims, 7 Drawing Sheets

FIG. 8

TABLE 1

| | | EXAMPLE 1 | EXAMPLE 2 |
|---|---|---|---|
| STATE OF COARSE FRAGMENTS M1 OF FABRIC AS RAW MATERIAL | TEXTURE OF FABRIC | PLAIN WEAVE | PLAIN WEAVE |
| | MATERIAL | COTTON 100% | |
| | BASIS WEIGHT | 270 | 164 |
| | THREAD STRUCTURE | RING SPUN YARN | |
| | THREAD COUNT [Ne] | 22/2 | 32 |
| | TWIST COUNT [T/INCH] OF PRE-DEFIBRATION THREADS T1 | 12.0 | 25.1 |
| | TWIST COEFFICIENT kA OF PRE-DEFIBRATION THREADS T1 | 2.55 | 4.44 |
| | AVERAGE THREAD LENGTH LA [mm] OF PRE-DEFIBRATION THREADS T1 | 20 | 20 |
| | FIBER DENSITY ρA [g/cm$^3$] OF PRE-DEFIBRATION THREADS T1 | 0.036 | 0.179 |
| STATE OF FIRST UNDEFIBRATED THREADS T2 CONTAINED IN FIRST DEFIBRATED MATERIAL M2 | TWIST COUNT [T/INCH] OF FIRST UNDEFIBRATED THREADS T2 | 11.1 | 20 |
| | TWIST COEFFICIENT kB OF FIRST UNDEFIBRATED THREADS T2 | 2.37 | 3.53 |
| | AVERAGE THREAD LENGTH LB [mm] OF FIRST UNDEFIBRATED THREADS T2 | 15.3 | 15.2 |
| | FIBER DENSITY ρB [g/cm$^3$] OF FIRST UNDEFIBRATED THREADS T2 | 0.025 | 0.085 |
| STATE OF FIBERS F CONTAINED IN SECOND DEFIBRATED MATERIAL M3 | AVERAGE FIBER LENGTH LC [mm] OF FIBERS F CONTAINED IN DEFIBRATED FIBER FLUFF | 16.5 | 17.3 |

FIG. 9

TABLE 2

| | EXAMPLE 1 | EXAMPLE 2 |
|---|---|---|
| $\rho B/\rho A$ | 0.69 | 0.47 |
| kB/kA | 0.93 | 0.8 |
| LB/LA | 0.77 | 0.76 |

FIG. 10

TABLE 3

| | | EXAMPLE 1 | EXAMPLE 2 |
|---|---|---|---|
| PROPORTIONS OF COMPONENTS CONTAINED IN FIRST DEFIBRATED MATERIAL M2 | PROPORTION [%] OF FIRST UNDEFIBRATED THREADS T2 | 78.4 | 96.9 |
| | PROPORTION [%] OF DEFIBRATED FIBER FLUFF | 21.6 | 3.1 |
| PROPORTIONS OF COMPONENTS CONTAINED IN SECOND DEFIBRATED MATERIAL M3 | PROPORTION [%] OF SECOND UNDEFIBRATED THREADS T3 | 20.8 | 50 |
| | PROPORTION [%] OF DEFIBRATED FIBER FLUFF | 79.2 | 50 |

FIBER PROCESSING METHOD

The present application is based on, and claims priority from JP Application Serial Number 2024-026257, filed Feb. 26, 2024, the disclosure of which is hereby incorporated by reference herein in its entirety.

BACKGROUND

1. Technical Field

The present disclosure relates to a fiber processing method.

2. Related Art

JP-T-2017-531103 discloses a technology for recycling fiber products such as clothing. In JP-T-2017-531103, finely separated fibers can be obtained by a cutting step of cutting a fiber product as a raw material using a cutting machine and a garnetting step of garnetting the cut pieces produced in the cutting step using a garnetting machine. Then, the finely separated fibers are reused.

However, with the method described in JP-T-2017-531103, it may be impossible to obtain finely separated fibers depending on conditions such as a type and a material of a raw material. For example, when the raw material contains threads in which fibers are relatively tightly twisted, it is not possible to finely separate the fibers with the method described in JP-T-2017-531103. The fibers that are not finely separated cannot be reused as they are, and a yield is thus reduced.

SUMMARY

According to an aspect of the present disclosure, a fiber processing method includes performing defibration processing on a coarse fragment of a fabric containing a thread in which a plurality of fibers are twisted to produce a first defibrated material; and performing garnetting processing on the first defibrated material to produce a second defibrated material.

BRIEF DESCRIPTION OF THE DRAWINGS

FIG. 8 is a table (Table 1) illustrating measured values in each example of the present disclosure.

FIG. 9 is a table (Table 2) illustrating measured values in each example of the present disclosure.

FIG. 10 is a table (Table 3) illustrating measured values in each example of the present disclosure.

DESCRIPTION OF EMBODIMENTS

Hereinafter, a fiber processing method according to the present disclosure will be described in detail based on embodiments illustrated in the accompanying drawings.

Embodiments

Figure 1:
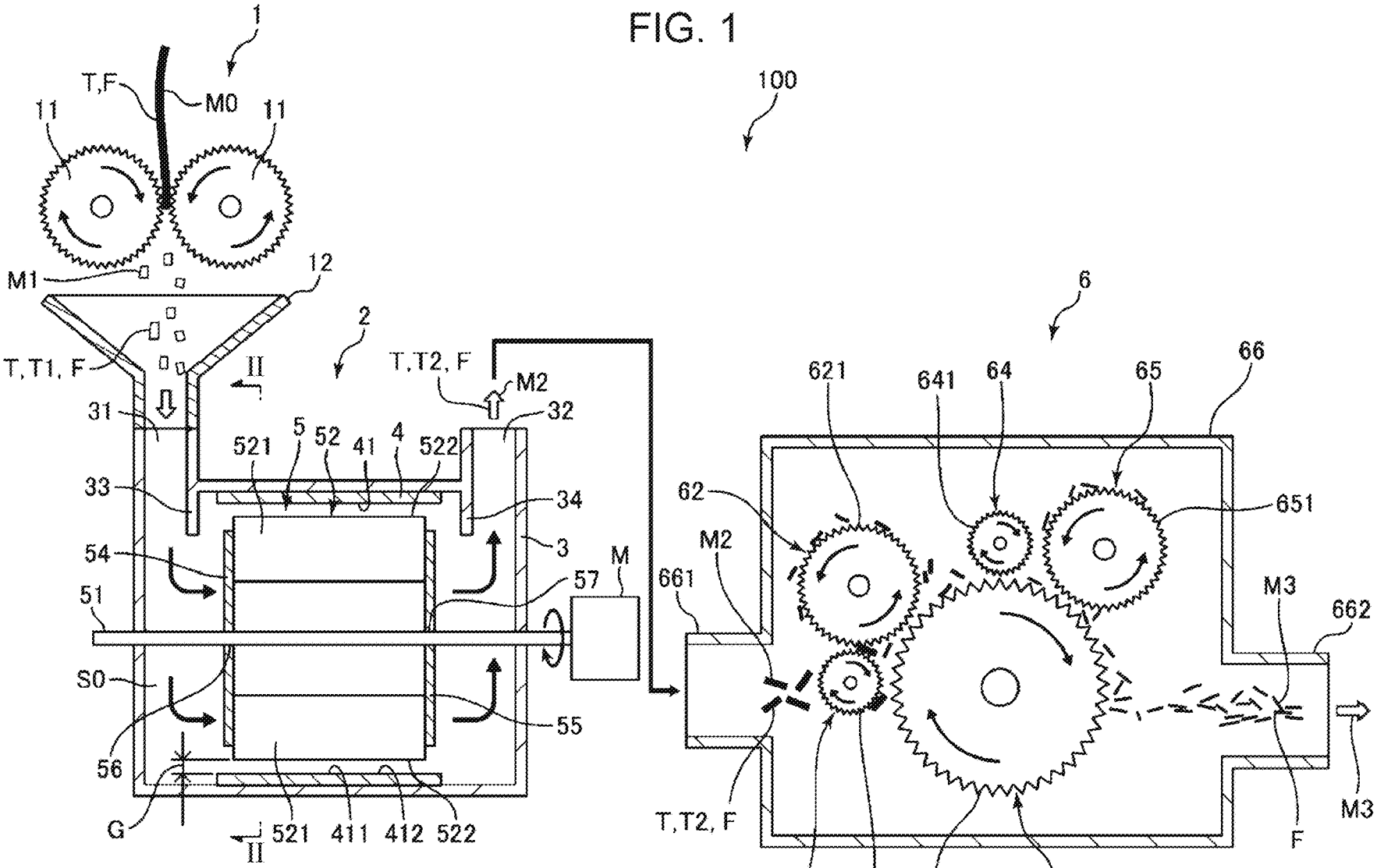
FIG. 1 is a longitudinal sectional view illustrating an embodiment of a fiber processing device that executes a fiber processing method according to the present disclosure.
Figure 2:
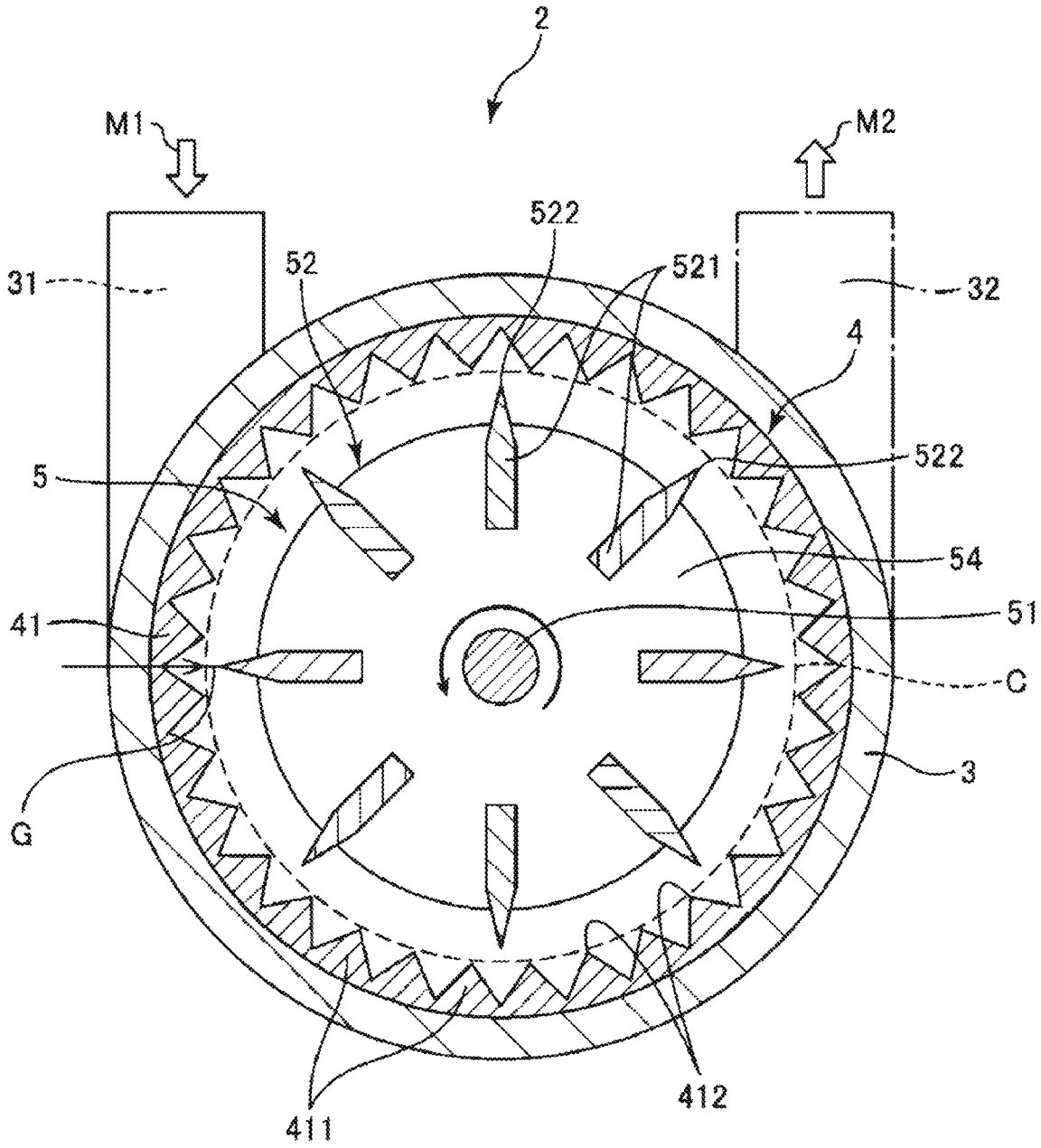
FIG. 2 is a sectional view taken along line II-II in FIG. 1.
Figure 3:
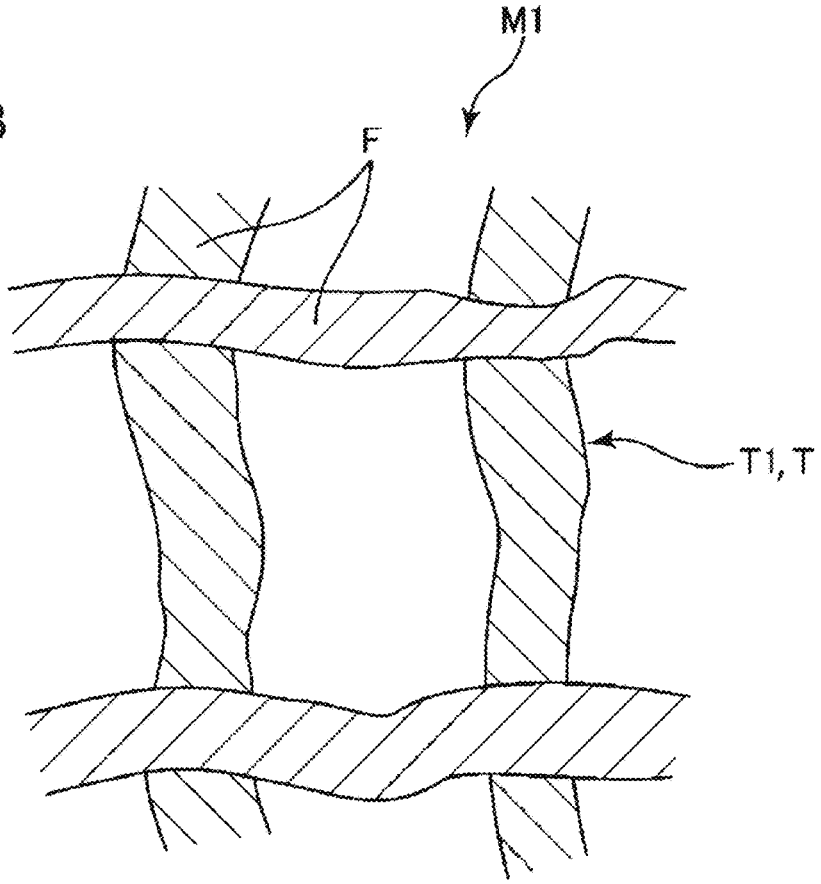
FIG. 3 is an enlarged schematic view of a coarse fragment illustrated in FIG. 1.
Figure 4:
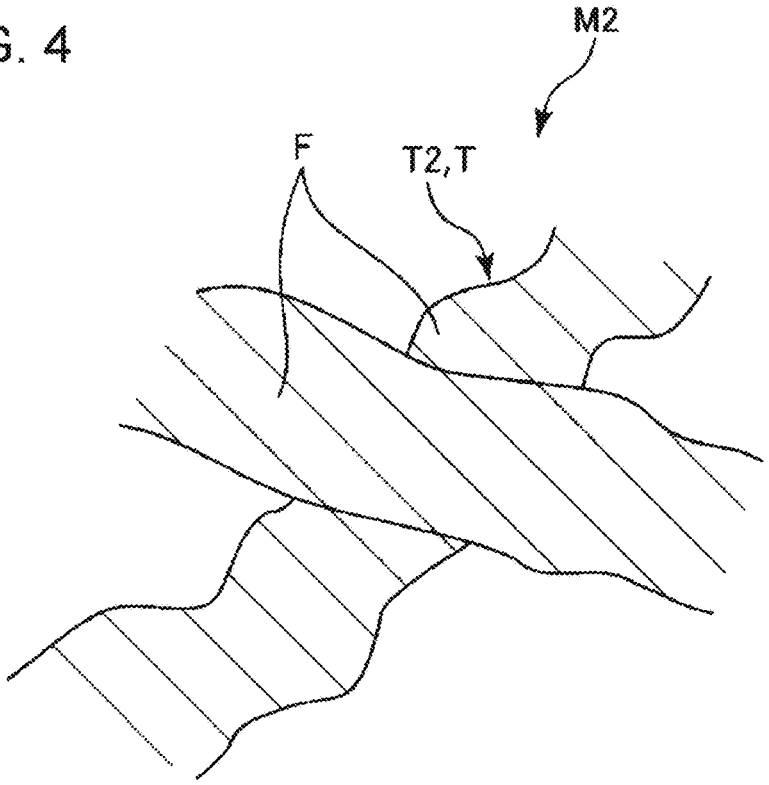
FIG. 4 is an enlarged schematic view of a first defibrated material illustrated in FIG. 1.
Figure 5:
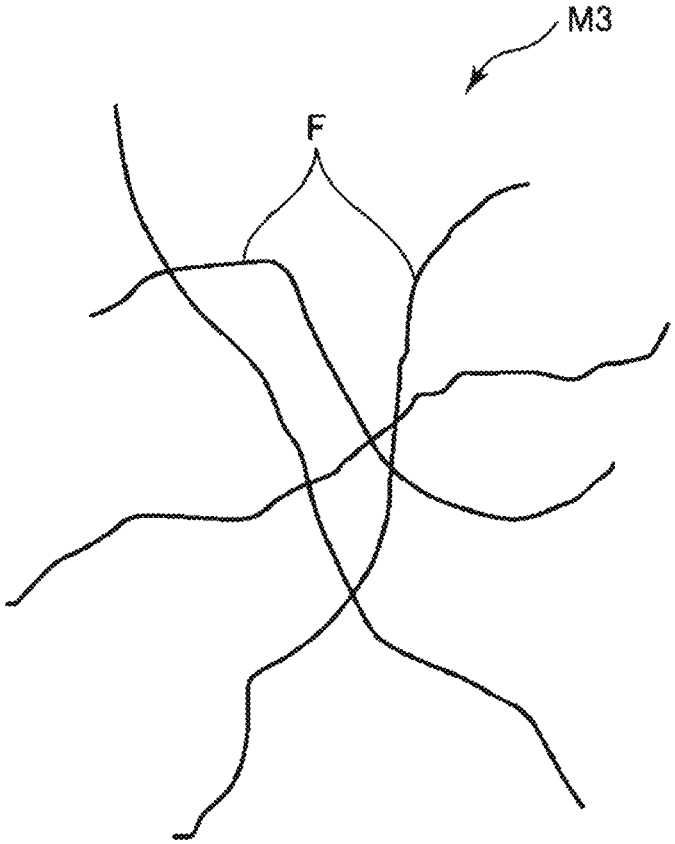
FIG. 5 is an enlarged schematic view of a second defibrated material illustrated in FIG. 1.
Figure 6:
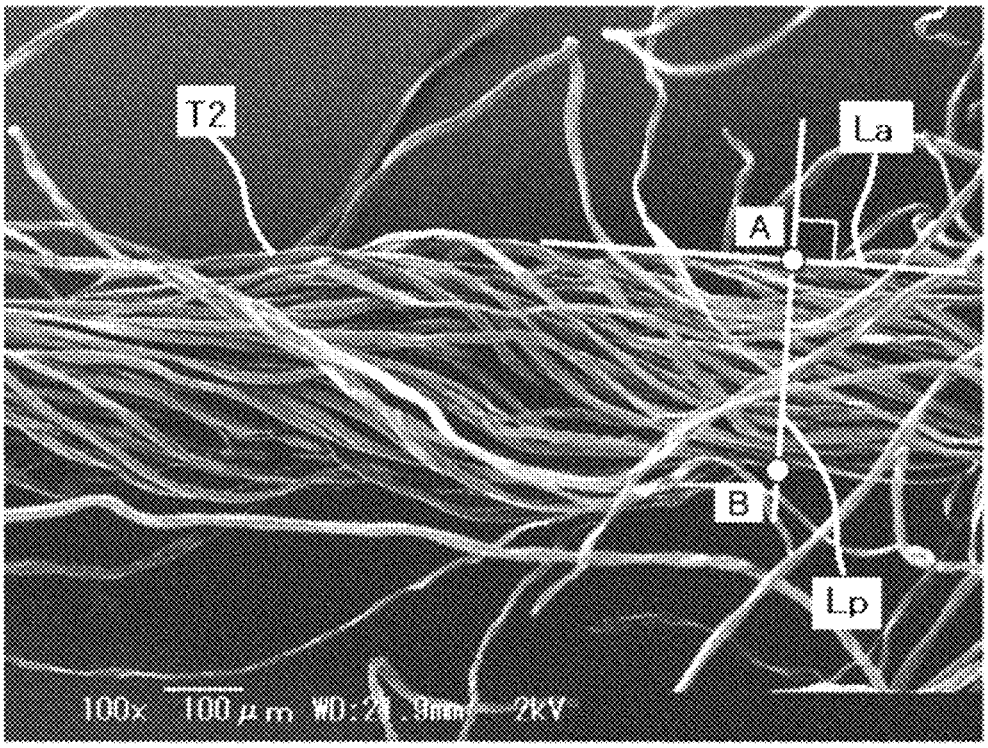
FIG. 6 is an enlarged photograph of a first undefibrated thread.
Figure 7:
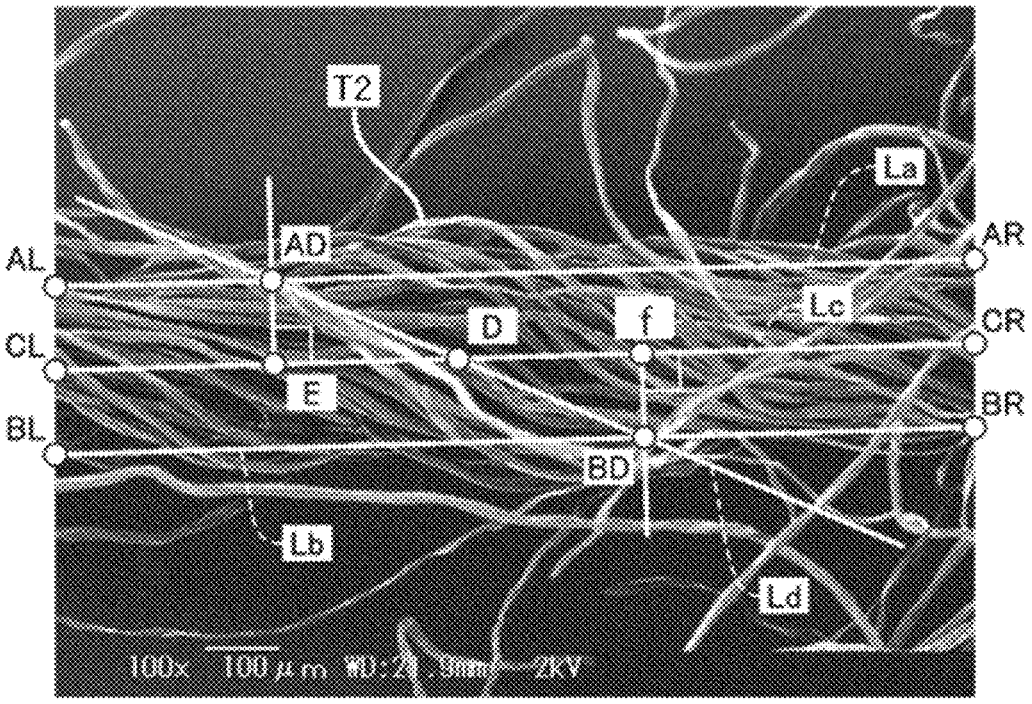
FIG. 7 is an enlarged photograph of the first undefibrated thread.

FIG. 1 is a longitudinal sectional view illustrating an embodiment of a fiber processing device that executes the fiber processing method according to the present disclosure. FIG. 2 is a sectional view taken along line II-II in FIG. 1. FIG. 3 is an enlarged schematic view of a coarse fragment illustrated in FIG. 1. FIG. 4 is an enlarged schematic view of a first defibrated material illustrated in FIG. 1. FIG. 5 is an enlarged schematic view of a second defibrated material illustrated in FIG. 1. FIGS. 6 and 7 are enlarged photographs of a first undefibrated thread.

In the following description, an upper side in FIG. 1 may be expressed as "above" or "upper side", and a lower side in FIG. 1 may be expressed as "below" or "lower side". A left side in FIG. 1 may be expressed as "left" or "left side", and a right side in FIG. 1 may be expressed as "right" or "right side".

A fiber processing device 100 illustrated in FIG. 1 executes the fiber processing method according to the present disclosure. The fiber processing device 100 processes a fabric of cloth, which is a raw material M0, and produces a second defibrated material M3 through coarse fragments M1 and a first defibrated material M2. The fiber processing device 100 includes a coarse fragmentation device 1, a defibration device 2, and a garnetting device 6.

Examples of the fabric, which is the raw material M0, include cloth (woven, nonwoven, or knitted cloth), clothing, handkerchiefs, towels, bedding, curtains, carpets, and other various cloth products, whether unused or used.

The second defibrated material M3 produced by the fiber processing device 100 is stored at a specified location (not illustrated), or is recycled into cloth or various cloth products via a spinning device (not illustrated).

As illustrated in FIG. 1, the coarse fragmentation device 1 is a device that coarsely fragments the raw material M0 to produce the coarse fragments M1. The raw material M0 is a fabric containing threads T in which fibers F are twisted. The fibers F contained in the raw material M0 are not particularly limited. Examples of the fibers F include natural fibers such as cotton, wool, silk, and hemp, regenerated fibers such as rayon, polynosic, cupra, and lyocell, and synthetic fibers such as nylon, polyester, acryl, vinylon, and polyurethane, and one or a combination of two or more of these fibers are used.

The coarse fragmentation device 1 includes a pair of coarse fragmentation blades 11 arranged parallel to each other and spaced apart from each other, and a chute 12 installed below the coarse fragmentation blades 11.

The pair of coarse fragmentation blades 11 rotate in opposite directions to coarsely fragment the raw material M0 between the coarse fragmentation blades 11, that is, cut the raw material M0 to produce the coarse fragments M1. The coarse fragments M1 may have a shape and size suitable for defibration processing in the defibration device 2. As for the shape of the coarse fragments M1, for example, the coarse fragments M1 may be small pieces with a square planar shape or small pieces with a rectangular planar shape, especially small pieces with a strip-like planar shape. As for the size of the coarse fragments M1, the size of the coarse fragments M1 is not particularly limited, and for example, the coarse fragments M1 may be small pieces with an average length of one side of 100 mm or less, and more specifically, may be small pieces with an average length of one side of 3 mm or more and 70 mm or less. The shape of the small pieces may be a shape other than a square or rectangle. Further, a thickness of the coarse fragments M1 is not particularly limited, and may be 0.07 mm or more and 5.00 mm or less.

The chute 12 is disposed below the pair of coarse fragmentation blades 11, and has, for example, a conical shape or a funnel shape. Thus, the chute 12 can receive the fallen coarse fragments M1 coarsely fragmented by the coarse fragmentation blades 11. A lower portion of the chute 12 is coupled to a feeding port 31 of the defibration device 2, and the coarse fragments M1 collected by the chute 12 are supplied to the defibration device 2 through the feeding port 31.

As illustrated in FIG. 3, the threads T are knitted or woven in the coarse fragments M1. The threads T contained in the coarse fragments M1 are hereinafter referred to as pre-defibration threads T1.

A twist coefficient kA of the fibers F in the pre-defibration threads T1 is not particularly limited, and may be 2 or more and 6 or less, more specifically, 3 or more and 5 or less.

A twist coefficient k in the present specification is calculated as (T/inch)/√count (Ne). T refers to the twist count per unit length (1 inch). Ne refers to a cotton count.

A density ρA of the fibers F in the pre-defibration threads T1 is not particularly limited, and may be 0.001 g/cm$^3$ or more and 1.500 g/cm$^3$ or less, more specifically, 0.010 g/cm$^3$ or more and 1.000 g/cm$^3$ or less.

An average thread length LA of the pre-defibration threads T1 is not particularly limited, and may be 10 mm or more and 100 mm or less, more specifically, 15 mm or more and 60 mm or less.

The coarse fragmentation device 1 may be omitted. When the coarse fragmentation device 1 is omitted, separately prepared coarse fragments or a raw material in a similar form is directly supplied to the defibration device 2.

The defibration device 2 illustrated in FIG. 1 is a device that defibrates the coarse fragments M1 in air to produce the first defibrated material M2. As illustrated in FIG. 1, the defibration device 2 includes a casing 3, a liner 4 disposed along an inner circumferential surface of the casing 3, a rotor 5 as a rotating body rotatably installed inside the casing 3, and a motor M that rotates and drives the rotor 5. The coarse fragments M1 are defibrated into the first defibrated material M2 when passing between an outer circumferential portion of the rotating rotor 5 and the liner 4.

The casing 3 has the feeding port 31 for feeding the coarse fragments M1 into the casing 3, and a discharge port 32 for discharging the produced first defibrated material M2 to the outside of the casing 3. The casing 3 is a cylindrical member having an internal space S0 for housing the liner 4 and the rotor 5.

The feeding port 31 is provided on a side near a left end portion of the casing 3. The feeding port 31 is also provided so as to protrude in a cylindrical shape outward from the casing 3 in a radial direction.

The discharge port 32 is provided on a side near a right end portion of the casing 3. The discharge port 32 is also provided so as to protrude in a cylindrical shape outward from the casing 3 in the radial direction.

The feeding port 31 and the discharge port 32 are positioned on an upper side of the casing 3 in FIG. 1. As illustrated in FIG. 2, a protruding direction of the feeding port 31 and the discharge port 32 is aligned with a tangent direction of an inner circumference of the casing 3. However, positions where the feeding port 31 and the discharge port 32 are formed are not limited to the above. The feeding port 31 and the discharge port 32 may be shifted by a certain angle or positioned on opposite sides, and there is no particular limitation on the protruding direction.

As illustrated in FIG. 1, the casing 3 includes partition plates 33 and 34 provided in the internal space S0. The partition plate 33 is provided on an extension of the feeding port 31, and is installed such that a thickness direction is aligned with a rotation shaft 51 described below. The partition plate 34 is provided on an extension of the discharge port 32, and is installed such that a thickness direction is aligned with the rotation shaft 51. The partition plates 33 and 34 are arranged approximately parallel to each other. End portions of the partition plates 33 and 34 that face the rotation shaft 51 are spaced apart from the rotation shaft 51.

As the partition plate 33 is provided, it is possible to smoothly introduce the coarse fragments M1 fed from the feeding port 31 to the vicinity of the rotation shaft 51. As a result, the partition plate 33 contributes to smooth transfer of the coarse fragments M1 in the internal space S0. Furthermore, as the partition plate 34 is provided, it is possible to smoothly guide the produced first defibrated material M2 to the discharge port 32. Therefore, it is possible to more smoothly discharge the first defibrated material M2.

As illustrated in FIGS. 1 and 2, the liner 4 is a cylindrical member disposed on the entire inner circumferential surface of a cylindrical portion between the feeding port 31 and the discharge port 32 of the casing 3. A central axis of the liner 4 is coaxial with the rotation shaft 51. As illustrated in FIGS. 1 and 2, an outer circumferential surface of the liner 4 is fixed to the inner circumferential surface of the casing 3. As illustrated in FIG. 1, a length of the liner 4 in an axial direction is large enough to encompass blades 521 described below. The liner 4 is made of a hard material such as metal.

In addition, teeth 41 are formed on an inner circumference of the liner 4 as fixed blades. The coarse fragments M1 are defibrated between the teeth 41 and the rotor 5. The teeth 41 are provided in a circumferential direction of the liner 4 and include a plurality of protruding portions 411 that protrude toward the center. The protruding portions 411 also extend in an axial direction of the casing 3. Each protruding portion 411 has the same protruding height and has a tip portion 412 that is a cutting edge. A circle C connecting the respective tip portions 412 is concentric with the rotation shaft 51.

When the coarse fragments M1 pass between the outer circumferential portion of the rotating rotor 5 and the teeth 41, the coarse fragments M1 collide with the protruding portions 411 of the teeth 41 and are defibrated, thereby producing the first defibrated material M2.

As illustrated in FIG. 1, the rotor 5 includes the rotation shaft 51, a rotor portion 52, a side plate 54 positioned on a left side of the rotor portion 52, and a side plate 55 positioned on a right side of the rotor portion 52.

The rotation shaft 51 has an elongated shape and is installed so as to extend through the casing 3 in a left-right direction. The rotation shaft 51 is rotatably supported by the casing 3 via bearings (not illustrated), and a right end portion of the rotation shaft 51 is coupled to an output shaft of the motor M. When the motor M is energized, the motor M is driven and the rotation shaft 51 rotates in a predetermined direction. A reducer (not illustrated) may be provided between the output shaft of the motor M and the rotation shaft 51.

The disc-shaped side plates 54 and 55 are fixed while being spaced apart from each other in the middle of the rotation shaft 51 in a longitudinal direction. The side plates 54 and 55 have through-holes 56 and 57 through which the rotation shaft 51 is inserted and fixed, the through-holes 56 and 57 being formed at the centers of the side plates 54 and 55, respectively. The rotation shaft 51 is fitted into the through-holes 56 and 57 formed in the side plates 54 and 55, and the side plates 54 and 55 are fixed to the rotation shaft 51.

As illustrated in FIGS. 1 and 2, the rotor portion 52 includes the blades 521 as a plurality of rotating blades arranged radially around the rotation shaft 51. In the present embodiment, the number of blades 521 is eight. The blades 521 are arranged at equal angular intervals around the rotation shaft 51. In the present disclosure, a size of the blade 521, the number of blades 521, an arrangement pattern of the blades 521, and the like are not particularly limited.

Each blade 521 has a plate shape, particularly, a flat plate shape, and is disposed such that each main surface is oriented in the radial direction of the casing 3 and the rotor 5. Each blade 521 is fixed to the side plate 54 and the side plate 55. An end portion 522 of each blade 521 on an outer circumferential side, that is, on a side farther from the rotation shaft 51, is spaced a predetermined distance from the tip portion 412 of the protruding portion 411, and rotates without contacting the liner 4. The side plate 54 and the side plate 55 are arranged at a predetermined interval in an axial direction of the rotation shaft 51 and are arranged approximately parallel to each other. The end portion 522 of the blade 521 on the outer circumferential side is the cutting edge.

Each blade 521 is not limited to a flat plate shape and may be curved or bent into a desired shape.

Each blade 521 is fixed to the rotation shaft 51 via the side plate 54 and the side plate 55. As a result, when the rotation shaft 51 rotates, each blade 521 rotates around the rotation shaft 51 together with the side plates 54 and 55. The coarse fragments M1 are defibrated when passing between the rotating blades 521 and the teeth 41 of the liner 4.

In the present embodiment, each blade 521 has the same shape and size. However, the blades 521 are not limited to such a configuration, and at least one of the blades 521 may have a different shape or size from the others.

Constituent materials of the teeth 41 and the blade 521 may be hard metal materials or ceramics, such as stainless steel, Inconel, Hastelloy, titanium or titanium alloys, carbon tool steel, alloy tool steel (carbon tool steel containing nickel, chromium, molybdenum, tungsten, or the like), high-speed steel (containing tungsten, vanadium, cobalt, or the like), powdered high-speed steel (high-speed steel material that is first powdered to remove impurities and then vacuum-melted to increase purity), cemented carbides (materials obtained by sintering materials mainly including tungsten carbide, titanium carbide, or tantalum carbide with cobalt), cermet, sintered aluminum oxide, cubic boron nitride, sintered diamond, and the like. The constituent materials of the teeth 41 and the blade 521 may be the same as or different from each other.

In FIG. 2, the discharge port 32 is positioned opposite to the feeding port 31 in the axial direction of the rotation shaft 51. Although the discharge port 32 is not actually present as shown, the discharge port 32 is indicated by a line with alternating long and short dashes for easier understanding of the arrangement or the like. However, the arrangement is not limited to such a configuration, and the feeding port 31 and discharge port 32 may be positioned at any position.

With such a defibration device 2, the coarse fragments M1 are subjected to the defibration processing to produce the first defibrated material M2. At this time, the defibration processing ends before the coarse fragments M1 are completely disintegrated into fibers by the defibration processing. The first defibrated material M2 produced in this manner includes defibrated fiber fluff in which the threads contained in the coarse fragments M1 are disintegrated into fibers, and undefibrated threads that are not defibrated and remain in the form of threads. In the defibration processing according to the present disclosure, an amount of the undefibrated threads may be larger than an amount of the defibrated fiber fluff. For example, as illustrated in FIG. 4, the first defibrated material M2 contains undefibrated threads T including the fibers F, and a content of the fibers F is approximately 50% by mass or more. The threads T contained in the first defibrated material M2 are hereinafter referred to as first undefibrated threads T2.

A twist coefficient kB of the fibers F in the first undefibrated threads T2 is not particularly limited, and may be 2.0 or more and 5.0 or less, more specifically, 2.5 or more and 4.0 or less.

A density ρB of the fibers F in the first undefibrated threads T2 is not particularly limited, and may be 0.001 $g/cm^3$ or more and 0.500 $g/cm^3$ or less, more specifically, 0.005 $g/cm^3$ or more and 0.250 $g/cm^3$ or less.

An average thread length LB of the first undefibrated threads T2 is not particularly limited, and may be 10 mm or more and 100 mm or less, more specifically, 15 mm or more and 80 mm or less.

As illustrated in FIG. 1, the garnetting device 6 is a device that performs garnetting processing on the first defibrated material M2 to produce the second defibrated material M3. The garnetting device 6 includes five garnetting rollers 61, 62, 63, 64, and 65, and a housing 66 that houses the garnetting rollers 61, 62, 63, 64, and 65. Each of the garnetting rollers 61, 62, 63, 64, and 65 is installed so as to be rotatable around a central axis. The garnetting rollers 61, 62, 63, 64, and 65 are installed such that rotation axes are parallel to each other. In the present embodiment, each of the garnetting rollers 61, 63, and 64 rotates clockwise in FIG. 1, and each of the garnetting rollers 62 and 65 rotates counterclockwise in FIG. 1.

The housing 66 has an introducing port 661 positioned at a left side portion and a discharge port 662 positioned at a right side portion. The introducing port 661 is coupled to the discharge port 32 of the defibration device 2 via a transfer pipe (not illustrated). The first defibrated material M2 discharged from the discharge port 32 and passing through the transfer pipe is introduced into the housing 66 through the introducing port 661. As the first defibrated material M2 introduced through the introducing port 661 in this manner is subjected to the garnetting processing by the garnetting rollers 61, 62, 63, 64, and 65, the fibers F are untangled, and the second defibrated material M3 is produced. The second defibrated material M3 is discharged through the discharge port 662.

An outer diameter of the garnetting roller 61 is smaller than that of the garnetting roller 62. An outer diameter of the garnetting roller 63 is larger than those of the garnetting rollers 61, 62, 64, and 65. The outer diameter of the garnetting roller 64 is the same as that of the garnetting roller 61. The outer diameter of the garnetting roller 65 is the same as that of the garnetting roller 62.

The garnetting roller 61 includes blades 611 positioned at an outer circumferential portion thereof. The garnetting roller 62 includes blades 621 positioned at an outer circumferential portion thereof. The garnetting roller 63 includes blades 631 positioned at an outer circumferential portion thereof. The garnetting roller 64 includes blades 641 positioned at an outer circumferential portion thereof. The garnetting roller 65 includes blades 651 positioned at an outer circumferential portion thereof.

The shapes (widths, heights, pitches, and the like), positions, and numbers of the blades 611, 621, 631, 641, and 651 formed may be the same as or different from each other.

The first defibrated material M2 discharged through the discharge port 32 of the defibration device 2 is introduced into the housing 66 through the introducing port 661 via the transfer pipe and is subjected to the garnetting processing by the blades 611, 621, 631, 641, and 651 while passing between the garnetting rollers 61, 62, 63, 64, and 65 in sequence.

The garnetting roller 61 and the garnetting roller 62 are installed in the housing 66 near the discharge port 32 of the defibration device 2. The garnetting roller 61 and the garnetting roller 62 are arranged in a vertical direction, the garnetting roller 62 being positioned above the garnetting roller 61. The garnetting roller 61 and the garnetting roller 62 rotate in opposite directions, and the first defibrated material M2 introduced into the housing 66 is first transported to the right side in FIG. 1 while being subjected to the garnetting processing by the blades 611 and 621.

The garnetting roller 63 is installed at a central portion of the housing 66 and rotates clockwise in FIG. 1. That is, the garnetting roller 63 is provided to the right of the garnetting rollers 61 and 62. The garnetting roller 63 rotates in the same direction as the garnetting roller 61, so that the first defibrated material M2 is transported along the outer circumferential portion of the garnetting roller 63 while being subjected to the garnetting processing by the blades 631.

The garnetting roller 64 is installed to the right of the garnetting rollers 61 and 62 and above the garnetting roller 63. The garnetting roller 63 and the garnetting roller 64 rotate in the same direction, so that the first defibrated material M2 is transported to the right side in FIG. 1 while being strongly subjected to the garnetting processing by the blades 631 and the blades 641.

The garnetting roller 65 is installed to the right of the garnetting roller 64 and above the garnetting roller 63. The garnetting roller 63 and the garnetting roller 65 rotate in opposite directions, so that the first defibrated material M2 is transported to the right side in FIG. 1 while being strongly subjected to the garnetting processing by the blades 631 and the blades 651.

The first defibrated material M2 introduced into the housing 66 through the introducing port 661 is subjected to the garnetting processing by the blades 611, 621, 631, 641, and 651 of the garnetting rollers 61, 62, 63, 64, and 65 that rotate in predetermined directions, thereby producing the second defibrated material M3. The produced second defibrated material M3 is discharged through the discharge port 662.

Constituent materials of the garnetting rollers 61, 62, 63, 64, and 65 or the blades 611, 621, 631, 641, and 651 are not particularly limited, and examples thereof include those listed as the constituent materials of the teeth 41 and the blade 521 described above.

As the garnetting processing is performed on the first defibrated material M2, the first undefibrated threads T2 are disintegrated into fibers, as a result of which the defibrated fiber fluff is produced. As illustrated in FIG. 5, the second defibrated material M3 mainly contains defibrated fiber fluff in which the fibers F are untangled into individual fibers. Furthermore, the second defibrated material M3 may contain second undefibrated threads T3 that have not been defibrated by the garnetting processing, and a content of the second undefibrated threads T3 is, for example, 50% by mass or less in the second defibrated material M3.

A density ρC of the fibers F of the defibrated fiber fluff contained in the second defibrated material M3 is not particularly limited, and may be 0.001 g/cm$^3$ or more and 0.500 g/cm$^3$ or less, more specifically, 0.005 g/cm$^3$ or more and 0.250 g/cm$^3$ or less.

An average fiber length LC of the fibers F of the defibrated fiber fluff contained in the second defibrated material M3 is not particularly limited, and may be 10 mm or more, more specifically, 15 mm or more.

In the related art, generally, cut pieces corresponding to the coarse fragments M1 are immediately subjected to garnetting processing to obtain regenerated fibers corresponding to the second defibrated material M3. However, in such a method according to the related art, depending on various conditions such as a type, a composition, a density, a twist coefficient, a fiber length, and a fiber diameter of fibers in threads contained in the cut pieces, some fibers are not sufficiently untangled, resulting in fibers that are difficult to use as regenerated fibers. Consequently, a yield is poor. The number of times the garnetting processing is performed may be increased in order to improve the yield. In this case, however, an average fiber length of the obtained regenerated fibers may be decreased or the fibers may be damaged, resulting in regenerated fibers with poor quality.

On the other hand, in the present disclosure, the defibration processing is performed before the garnetting processing. That is, in the defibration processing, the threads T (pre-defibration threads T1) of the coarse fragments M1 are disintegrated, and the twist of the fibers F is slightly weakened to produce the first undefibrated threads T2. Then, the garnetting processing is performed on the first undefibrated threads T2. With this method, it is possible to quickly obtain high-quality recyclable fibers with a high yield, regardless of various conditions such as a type, a density, a composition, a twist coefficient, a fiber length, and a fiber diameter of the threads T (pre-defibration threads T1) of the coarse fragments M1 (hereinafter, simply referred to as "various conditions"). Furthermore, in the garnetting processing, the closer the material to be processed is to the form of threads, the higher the defibration efficiency. Therefore, the first undefibrated threads T2 contained in the first defibrated material M2 are disintegrated into fibers by the garnetting processing performed for a relative short time. As a result, a time required for the garnetting processing is shortened. Furthermore, the shorter the garnetting processing time, the less the fibers deteriorate, so that high-quality fibers can be taken out as regenerated fibers.

As described above, the fiber processing method according to the present disclosure includes performing the defibration processing on the coarse fragments M1 of the raw material M0, which is a fabric containing the threads T (pre-defibration threads T1) in which a plurality of fibers are twisted, to produce the first defibrated material M2, and performing the garnetting processing on the first defibrated material M2 to produce the second defibrated material M3. As a result, it is possible to quickly and satisfactorily produce the second defibrated material M3 with a high yield, regardless of various conditions such as the type, the density, the composition, the twist coefficient, the fiber length, and the fiber diameter of the threads T (pre-defibration threads T1) of the coarse fragments M1.

In the fiber processing method according to the present disclosure, the defibration processing is performed using the defibration device 2, and the garnetting processing is performed using the garnetting device 6. As a result, each processing can be performed more quickly and satisfactorily, and the quality of the obtained second defibrated material M3 is uniform. In addition, each processing can be automated. Therefore, the second defibrated material M3 can be produced efficiently with a high yield.

The first defibrated material M2 contains the first undefibrated threads T2, and ρB/ρA may be 0.2 or more and 0.9 or less, more specifically, 0.3 or more and 0.8 or less, where ρA represents the density of the fibers F in the pre-defibration threads T1 contained in the coarse fragments M1, and ρB represents the density of the fibers F in the first undefibrated threads T2 contained in the first defibrated material M2. By performing the processing so as to satisfy such conditions, it is possible to quickly and satisfactorily produce the second defibrated material M3 with a high yield.

When ρB/ρA is excessively large, the defibration processing may be insufficient depending on various conditions, and the effect of the present disclosure may be weakened. On the other hand, when ρB/ρA is excessively small, the defibration processing is performed sufficiently, but the time required for the defibration processing tends to increase and the average fiber length of the fibers F of the first undefibrated threads T2 tends to become relatively short.

The first defibrated material M2 contains the first undefibrated threads T2, and kB/kA may be 0.2 or more and less than 1.0, more specifically, 0.3 or more and 0.95 or less, where kA represents the twist coefficient of the fibers F in the pre-defibration threads T1 contained in the coarse fragments M1, and kB represents the twist coefficient of the fibers F in the first undefibrated threads T2 contained in the first defibrated material M2. By performing the processing so as to satisfy such conditions, it is possible to quickly and satisfactorily produce the second defibrated material M3 with a high yield.

When kB/kA is excessively large, the defibration processing may be insufficient depending on various conditions, and the effect of the present disclosure may be weakened. On the other hand, when kB/kA is excessively small, the defibration processing is performed sufficiently, but the time required for the defibration processing tends to increase and the average fiber length of the fibers F of the first undefibrated threads T2 tends to become relatively short.

The first defibrated material M2 contains the first undefibrated threads T2, and LB/LA may be 0.1 or more and 0.95 or less, more specifically, 0.7 or more and 0.9 or less, where LA represents the average thread length of the pre-defibration threads T1 contained in the coarse fragments M1, and LB represents the average thread length of the first undefibrated threads T2 contained in the first defibrated material M2. By performing the processing so as to satisfy such conditions, it is possible to quickly and satisfactorily produce the second defibrated material M3 with a high yield.

When LB/LA is excessively large, the defibration processing may be insufficient depending on various conditions, and the effect of the present disclosure may be weakened. On the other hand, when LB/LA is excessively small, the second defibrated material M3 may not be suitable for regeneration depending on various conditions and a product to be recycled.

The fiber processing method according to the present disclosure includes, before performing the defibration processing, coarsely fragmenting the raw material M0, which is a fabric, to produce the coarse fragments M1. As a result, it is possible to easily and appropriately produce coarse fragments M1 that are suitable for the defibration processing. As a result, it is possible to more satisfactorily perform the garnetting processing. In addition, the coarse fragmentation processing for the fabric, the defibration processing, and the garnetting processing can be performed consecutively, and production efficiency for the second defibrated material M3 can be improved.

Hereinabove, the fiber processing method according to the present disclosure has been described with reference to the illustrated embodiment, but the present disclosure is not limited thereto, and each processing in the fiber processing method can be replaced with any processing that can provide the same function. Moreover, any configuration may be added to the fiber processing method.

Examples

Results obtained by implementing the present disclosure described above will be described as examples. Examples 1 and 2 illustrated in Tables 1 to 3 in FIGS. 8 to 10 show characteristics of products when plain-woven cotton fabrics with different compositions were subjected to the defibration processing and the garnetting processing based on the above-described embodiment. In Example 1, a fabric with a basis weight of 270, a thread count of 22/2, a twist count of 12.0 for threads contained in the fabric, and a twist coefficient of 2.55 was used as a raw material, while in Example 2, a fabric with a basis weight of 164, a thread count of 32, a twist count of 25.1 for threads contained in the fabric, and a twist coefficient of 4.44 was used as a raw material.

Measurement Methods

Measured values of Examples 1 and 2 were obtained by the following measurement methods. The measurement methods described below are known measurement methods, as disclosed in Japanese Patent No. 6556974.

(1) Basis Weight

The basis weight was measured in accordance with JIS L 1096 (2010).

(2) Thread Count

The thread count was measured in accordance with a cotton count measurement method for measuring a correct tex and count of general spun yarn in 9.4.1 in JIS L 1095:2010.

(3) Twist Count and Twist Coefficient

The twist count was measured in accordance with Method A in 9.15.1 in JIS L 1095:2010, and the twist coefficient was calculated using the following formula:

$$\text{Twist Coefficient}=\text{Twist Count } (T/\text{inch})/\sqrt{\text{Count } (Ne)}$$

(4) Density ρB of First Undefibrated Threads T2

A calculation procedure for the density ρB of the fibers contained in the first undefibrated threads T2 is described below.

(I) Calculation of Thread Diameter Based on Side Observation of First Undefibrated Threads T2

Imaging was performed using a microscope to obtain an image of a thread form of the first undefibrated thread T2 contained in the first defibrated material M2. A first undefibrated thread T2 in a tension-free state was placed horizontally, and a side surface of the first undefibrated thread T2 was imaged at a magnification of 40 to 100 times using a digital microscope VHX-5000 manufactured by KEYENCE CORPORATION. The captured image is illustrated in FIG. 6. As illustrated in FIG. 6, a tangent line La extending in a longitudinal direction of the thread was drawn for the outermost fiber among the fibers contained the thread, and a perpendicular line Lp perpendicular to the tangent line La was drawn at an arbitrary portion of the first undefibrated thread T2. An intersection point between the perpendicular line Lp and the tangent line La is called an intersection point A. Furthermore, the outermost fiber on a side opposite to the tangent line La across a central axis of the thread was specified, and an intersection point between the fiber and the perpendicular line Lp was designated as an intersection point B. A distance between the intersection point A and the intersection point B was measured from the image, and the distance was considered to be a diameter of the first undefibrated thread T2. Five images of different portions were captured for one sample. Thread diameters of five portions in each image were obtained and used as representative values for the image. Furthermore, an average value of the five images was obtained and used as a representative value for the sample. A fiber having a portion that is away from an adjacent fiber by a distance that is five times or more the diameter of the fiber in a central direction of a cross section of the thread was excluded from the outermost fibers for the measurement.

(II) Calculation of Density ρB of First Undefibrated Threads T2

The density ρB of the first undefibrated threads T2 was calculated by dividing a weight of the thread per unit length by a volume of the thread per unit length. A detailed calculation method is as follows, and the density obtained by such calculation is called an apparent density of the thread.

First, a weight of the thread per unit length (1 m) was calculated from a correct count (Correct Tex and Count in 9.4.1 in JIS L 1095). Then, a cross-sectional area of the thread when the cross section of the thread was considered to be a circle was calculated using the diameter of the thread measured in (I) above. The volume of the thread per unit length (1 m) was obtained by multiplying the cross-sectional area by 1. Then, the apparent density of the thread was calculated by dividing the weight per unit length by the volume per unit length. The apparent density is the density ρB of the first undefibrated thread T2. The lower the apparent density, the larger the volume of the thread per unit length.

(5) Proportion of First Undefibrated Threads T2 Contained in First Defibrated Material M2

After the defibration processing, the first defibrated material M2 contained thread-like undefibrated threads that maintained a state in which the fibers were twisted into a bundle, and the defibrated fiber fluff that had been disintegrated into the fibers. 50.0 mg±0.5 mg of the first defibrated material M2 was collected, the first undefibrated threads T2 were collected from the first defibrated material M2, and the weight of the first undefibrated threads T2 was measured. A proportion of the weight of the first undefibrated threads T2 relative to the weight of the first defibrated material M2 was then calculated. The measurement was performed twice to obtain an average value, and the average value was used as a representative value for the sample.

(6) Twist Count and Twist Coefficient of First Undefibrated Threads T2 Contained in First Defibrated Material M2

(I) Measurement of Twist Count Based on Side Observation of Thread (a) As illustrated in FIG. 7, a first undefibrated thread T2 was placed horizontally, and an image of a side surface of the thread (a magnification of 50 to 100 times) was obtained using an electron microscope VE-9800 manufactured by KEYENCE CORPORATION.

(b) The outermost end points AL and AR were obtained for intersection points between a fiber present on the outermost side of the side surface of the thread and straight lines made by edges of the image, and a straight line La was drawn by connecting the two points on an upper side of the obtained image of the side surface of the thread. A fiber having a portion that is away from an adjacent fiber by a distance that is five times or more the diameter of the fiber in a central direction of a cross section of the thread was excluded from measurement targets.

(c) The outermost end points BL and BR were obtained for intersection points between a fiber present on the outermost side of the side surface of the thread and the straight lines made by the edges of the image, and a straight line Lb was drawn by connecting the two points on a lower side of the obtained image of the side surface of the first undefibrated thread T2. A fiber having a portion that is away from an adjacent fiber by a distance that is five times or more the diameter of the fiber in a central direction of a cross section of the thread was excluded from measurement targets.

(d) CL and CR were obtained as midpoints of the thread in a cross-sectional direction at left and right ends of the image of the side surface of the first undefibrated thread T2, respectively, and a thread axis Lc was obtained by connecting the two points with a straight line.

(e) An intersection point between an arbitrary fiber on a thread surface and the thread axis Lc was designated as an intersection point D, and a tangent line Ld for the fiber on the thread surface was drawn so as to pass through the intersection point D. An intersection point between La and Ld was designated as AD, and an intersection point between Lb and Ld was designated as BD.

(f) A perpendicular line was drawn from AD to Lc, and an intersection point E between the perpendicular line and Lc was obtained. A perpendicular line was drawn from BD to Lc, and an intersection point F between the perpendicular line and Lc was obtained.

(g) A length between the intersection points E and F was measured to determine a length required for the fiber to make half a turn, that is, a thread length per 0.5 twist count. The twist count per inch was obtained from the thread length. The measurement was performed five times for each image, and an average value thereof was used as a representative value for the image. The measurement was performed for three images, and an average value thereof was used as a representative value.

(II) Calculation of Twist Coefficient

The twist coefficient was calculated using the following formula.

$$\text{Twist Coefficient}=\text{Twist Count } (T/\text{inch})/\sqrt{\text{Count } (Ne)}$$

(7) Average Thread Length LB of First Undefibrated Threads T2

Measurement was performed for the first undefibrated threads T2 separated in (5) above in accordance with Method C in JIS L 1015. The first undefibrated threads T2 were taken out one by one at random and laid straight without being stretched, and a length of the first undefibrated threads T2 was measured on a measuring table. An average value of the lengths of 200 threads was used as a representative value.

(8) Proportions of Defibrated Fiber Fluff (Fibers) and Second Undefibrated Threads T3 Contained in Second Defibrated Material M3

A thread-like material in which fibers are twisted into a bundle was extracted from the second defibrated material M3 as the second undefibrated threads T3. Furthermore, the fibers that were defibrated and turned into a fluff-like material were extracted as the defibrated fiber fluff. 50.0 mg±0.5 mg of the second defibrated material M3 was collected and separated into the defibrated fiber fluff and the undefibrated threads, a weight of the defibrated fiber fluff and a weight of the undefibrated threads were measured, and proportions of the weights of the defibrated fiber fluff and the undefibrated threads relative to a weight of the second defibrated material M3 were calculated. The measurement was performed twice to obtain an average value, and the average value was used as a representative value for the sample.

(9) Length of Fibers F of Defibrated Fiber Fluff Contained in Second Defibrated Material M3

Measurement was performed for the fibers F contained in the defibrated fiber fluff separated in (8) above in accordance with Method C in JIS L 1015. The fiber was taken out one by one at random and laid straight without being stretched, and a length of the fiber was measured on a measuring table. An average value of the lengths of 200 fibers was used as a representative value.

Measured values obtained by the above-described measurement methods are illustrated in Tables 1 to 3 in FIGS. 8 to 10. As can be seen from Table 1, in both Example 1 and Example 2, the length of the first undefibrated threads T2 contained in the first defibrated material M2 did not significantly decrease from a thread length of the raw material even after the defibration processing, and furthermore, the length of the fibers F after the garnetting processing was equivalent to the length of the first undefibrated threads T2. Therefore, the fibers F suitable for recycling were able to be produced by performing the processing according to the present disclosure on the fabric as the raw material. The reason why the length of fibers F is slightly larger than the length of the first undefibrated threads T2 is presumably because when the first undefibrated threads T2 were defibrated by the garnetting processing, the twisted fibers were untangled, causing the apparent length to be slightly larger.

Furthermore, the values of the twist count, the twist coefficient, and the fiber density of the first undefibrated threads T2 did not change significantly from the respective values of the pre-defibration threads T1. This means that even when the coarse fragments M1 are disintegrated by the defibration processing, most of the fibers remain in the form of threads. Then, the fibers F suitable for recycling can be obtained by performing the garnetting processing on the first defibrated material M2 that remains in the form of threads.

In addition, Table 2 shows calculated ratios of the measured values of the fiber density, the twist coefficient, and the fiber length before and after the defibration processing in Examples 1 and 2. All of the values are within appropriate ranges, indicating that the defibration processing resulted in the first undefibrated threads T2 with desired characteristics.

In addition, Table 3 shows proportions of the components contained in the first defibrated material M2 and the second defibrated material M3. In both Examples 1 and 2, it can be seen that the first undefibrated threads T2 occupy the majority of the first defibrated material M2, and many fibers remain in the form of threads even after the defibration processing.

Then, as most of the threads are disintegrated into fibers by the garnetting processing, the proportion of the threads in the second defibrated material M3 is greatly reduced. As a result, a necessary and sufficient amount of fiber (defibrated fiber fluff) for recycling can be obtained.

With a garnetting technology according to the related art, it is difficult to disintegrate a fabric containing strongly twisted threads into fibers, and such a fabric is difficult to recycle and thus has to be discarded. In contrast, as is clear from the above examples, the present disclosure makes it possible to take out fibers suitable for recycling from a fabric containing twisted threads, making it possible to recycle a fabric that has to be discarded in the related art.

What is claimed is:

1. A fiber processing method comprising:

performing defibration processing on a coarse fragment of a fabric containing a thread in which a plurality of fibers are twisted to produce a first defibrated material that includes an undefibrated thread, the defibration processing being performed using a defibration device that includes fixed teeth and a single rotor on which a plurality of rotor blades are formed, by defibrating the coarse fragment between the fixed teeth and the plurality of rotor blades, the fixed teeth facing the plurality of rotor blades; and performing garnetting processing on the first defibrated material to produce a second defibrated material that includes defibrated fiber fluff, the garnetting processing being performed using a garnetting device that includes a plurality of rollers by untangling the first defibrated material between the plurality of rollers, the plurality of rollers being arranged such that one roller of the plurality of rollers faces other rollers of the plurality of rollers, each of the plurality of rollers having blades, the garnetting processing being performed after the defibration processing.

2. The fiber processing method according to claim 1, wherein $\rho B/\rho A$ is 0.2 or more and 0.9 or less, where $\rho A$ represents a density of fibers in a pre-defibration thread contained in the coarse fragment, and $\rho B$ represents a density of fibers in the undefibrated thread contained in the first defibrated material.

3. The fiber processing method according to claim 1, wherein $kB/kA$ is 0.2 or more and less than 1.0, where $kA$ represents a twist coefficient of fibers in a pre-defibration thread contained in the coarse fragment, and $kB$ represents a twist coefficient of fibers in the undefibrated thread contained in the first defibrated material.

4. The fiber processing method according to claim 1, wherein $LB/LA$ is 0.1 or more and 0.95 or less, where $LA$ represents an average thread length of a pre-defibration thread contained in the coarse fragment, and $LB$ represents an average thread length of the undefibrated thread contained in the first defibrated material.

5. The fiber processing method according to claim 1, further comprising, before performing the defibration processing, coarsely fragmenting the fabric to produce the coarse fragment.

* * * * *